US011712107B1

(12) United States Patent
Jennett

(10) Patent No.: US 11,712,107 B1
(45) Date of Patent: Aug. 1, 2023

(54) CLIP FOR SECURING AN UNBUCKLED BELT

(71) Applicant: David M. Jennett, Arlington, TX (US)

(72) Inventor: David M. Jennett, Arlington, TX (US)

( * ) Notice: Subject to any disclaimer, the term of this patent is extended or adjusted under 35 U.S.C. 154(b) by 0 days.

(21) Appl. No.: 17/521,314

(22) Filed: Nov. 8, 2021

Related U.S. Application Data

(60) Provisional application No. 63/110,642, filed on Nov. 6, 2020.

(51) Int. Cl.
*A45F 5/02* (2006.01)
*A44B 11/02* (2006.01)

(52) U.S. Cl.
CPC ..... *A45F 5/021* (2013.01); *A44B 11/02* (2013.01)

(58) Field of Classification Search
CPC . A44B 11/02; A45F 5/021; A45F 5/00; A45F 5/02; Y10T 24/4755; A41F 9/002; A41F 9/025
USPC ..... 24/3.12
See application file for complete search history.

(56) References Cited

U.S. PATENT DOCUMENTS 239,123 A * 3/1881 Thurber ..... F16B 45/00 24/698.2
5,797,171 A 8/1998 Nelson
6,209,766 B1 * 4/2001 Kwon ..... A45F 5/021 224/684
6,279,362 B1 8/2001 Lee
9,341,285 B2 * 5/2016 Magno, Jr. ..... F16L 3/10
2004/0040991 A1 * 3/2004 McCoy ..... A45F 5/021 224/269
2005/0145664 A1 * 7/2005 Fappiano ..... A45F 5/021 224/678
2009/0260191 A1 * 10/2009 Cornelison ..... A45F 5/021 24/3.12
2012/0228293 A1 * 9/2012 Combs ..... A45F 5/02 220/660
2014/0259545 A1 9/2014 King
2015/0201689 A1 7/2015 Halbert
2017/0280863 A1 * 10/2017 Simon ..... A45F 5/021
2018/0132537 A1 5/2018 Siegfried

* cited by examiner

*Primary Examiner* — Robert Sandy
(74) *Attorney, Agent, or Firm* — Kenneth L. Tolar

(57) ABSTRACT

A clip for securing an unbuckled belt loaded with accessory items includes a hollow sleeve having an open first end, an open second end, a rear surface, and a front surface. A channel extending from the first end to the second end is dimensioned and configured to firmly receive a garment belt. The second end includes a J-shaped hook member extending outwardly therefrom for gripping a trouser belt loop. Accordingly, a belt loaded with accessory items is passed through the channel and is buckled in a conventional fashion. The hook is then secured to a nearby belt loop such that when the belt is unbuckled, the clip prevents the belt from slipping through the pants loops and falling onto an underlying surface.

4 Claims, 4 Drawing Sheets

CLIP FOR SECURING AN UNBUCKLED BELT

CROSS REFERENCE TO RELATED APPLICATIONS

This application claims priority of provisional application No. 63/110,642 filed on Nov. 6, 2020, the specification of which is incorporated herein by reference.

BACKGROUND OF THE INVENTION

The present invention relates to a uniquely designed clip that secures an unbuckled belt loaded with accessory items.

DESCRIPTION OF THE PRIOR ART

Attaching accessory items to a belt provides convenient access and frees the hands for other tasks. Typically, a user will attach such items to a trouser belt instead of wearing a separate utility belt to minimize bulk and discomfort. However, when the belt is unbuckled, the weight of the accessory items pulls the belt from the pants loops, causing it to drop onto an underlying surface. Delicate equipment, such as phones or radios, can suffer significant impact damage if dropped, requiring costly repairs or replacement. Dropping a firearm can cause an accidental discharge that can injure or kill an innocent bystander. Accordingly, there is currently a need for a device that secures an unbuckled belt loaded with accessory items.

A review of the prior art reveals various retainers that prevent trousers from slipping or clips for attaching accessory items to a belt. For example, U.S. patent publication no. 2015/0201689 to Halbert discloses a device for anchoring a wearer's lower garment when loaded with accessory items. The device includes a tubular housing having an engagement clip and a belt retainer that prevent a trouser from slipping down when the belt or pockets are loaded with heavy items.

U.S. Pat. No. 5,797,171 to Nelson discloses a buckleless belt including concealed engagement wires at a first end and a hook at a second end for gripping the concealed wires.

U.S. Pat. No. 6,279,362 to Lee discloses a belt clip for securing accessory items that includes a locking mechanism for preventing inadvertent displacement.

U.S. patent publication no. 2014/0259545 to King discloses a belt having a buckle mechanism with no adjustment holes or buckle prong for more precise, incremental adjustment.

U.S. patent publication no. 2018/0132537 to Siegfried discloses a device for restraining a shirt including a plurality of hooks attachable to a shirt and a curved hook attachable to a belt.

As indicated above, several belt and clothing clips exist in the prior art. However, none of the above-referenced devices are specifically designed to secure a loaded belt when unbuckled.

SUMMARY OF THE INVENTION

The present invention relates to a clip for securing an unbuckled belt loaded with accessory items, such as a phone, a gun, or a radio. The device comprises a hollow sleeve having an open first end, an open second end, a rear surface, and a front surface. A channel extending from the first end to the second end is dimensioned and configured to firmly receive a garment belt. The second end includes an outwardly extending J-shaped hook member for gripping a trouser belt loop. Accordingly, a belt loaded with accessory items is passed through the channel and buckled in a conventional fashion. The hook is then secured to a nearby belt loop such that when the belt is unbuckled, the clip prevents the belt from slipping through the pants loops and falling onto an underlying surface.

It is therefore an object of the present invention to provide a clip that retains heavy accessory items on an unbuckled belt.

It is therefore another object of the present invention to provide a clip that prevents a loaded belt from falling onto an underlying surface.

It is yet another object of the present invention to provide a clip that minimizes the risk of damaging accessory items stored on a garment belt.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
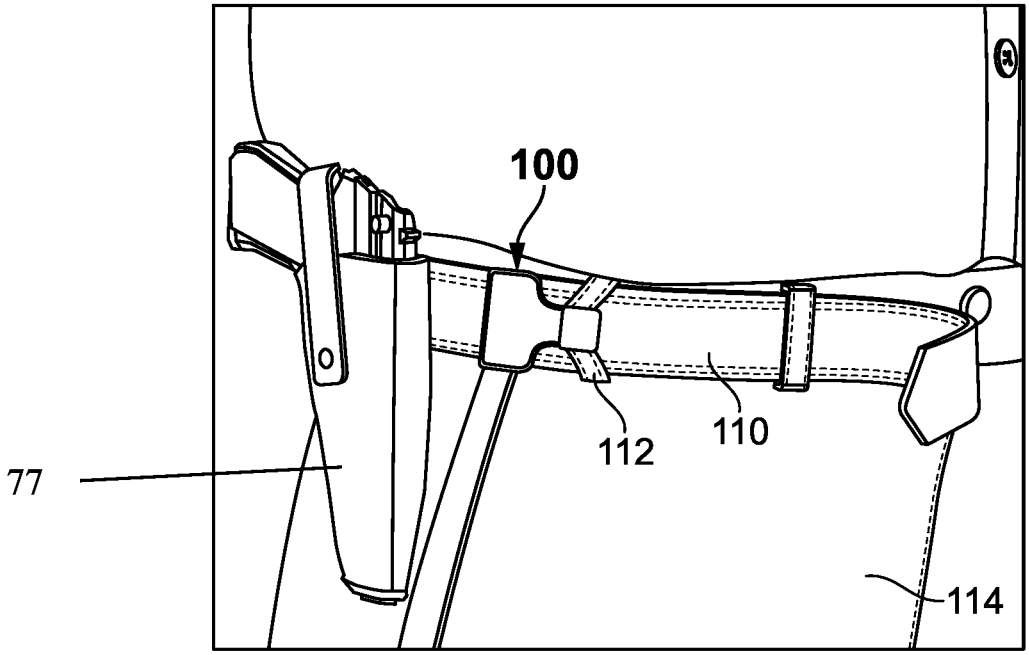
FIG. 1 depicts the clip according to the present invention securing a belt and an attached firearm.
Figure 2:
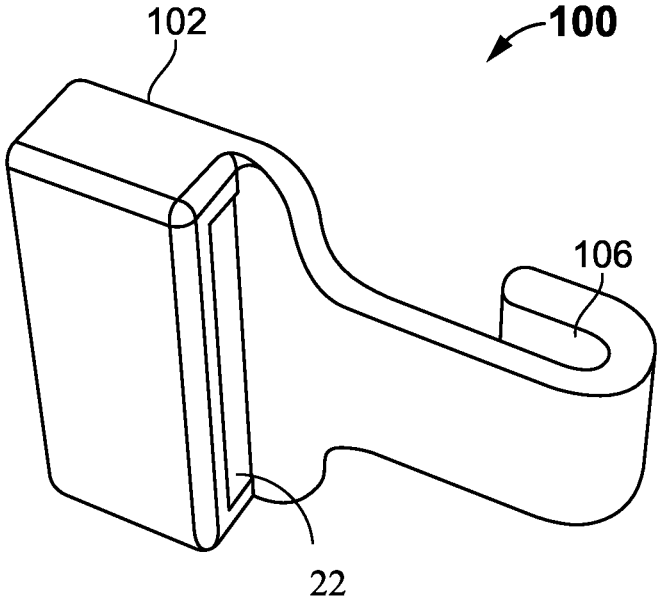
FIG. 2 is an isolated, perspective view of the clip.
Figure 3:
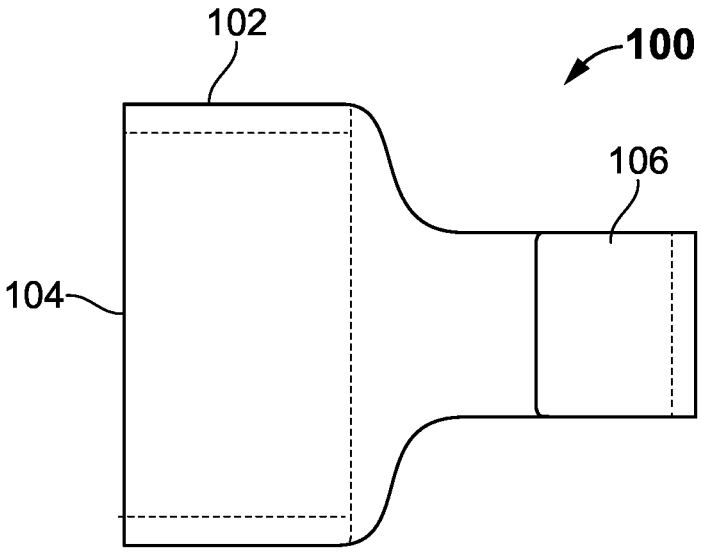
FIG. 3 is a rear, plan view of the clip.
Figure 4:
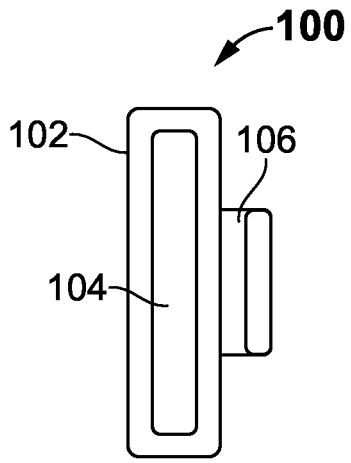
FIG. 4 is a side view of the clip.
Figure 5:
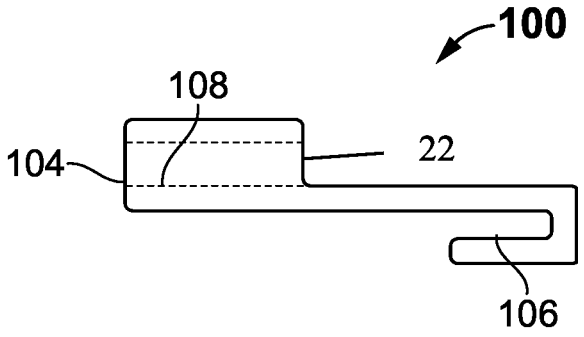
FIG. 5 is a top view of the clip.
Figure 6:
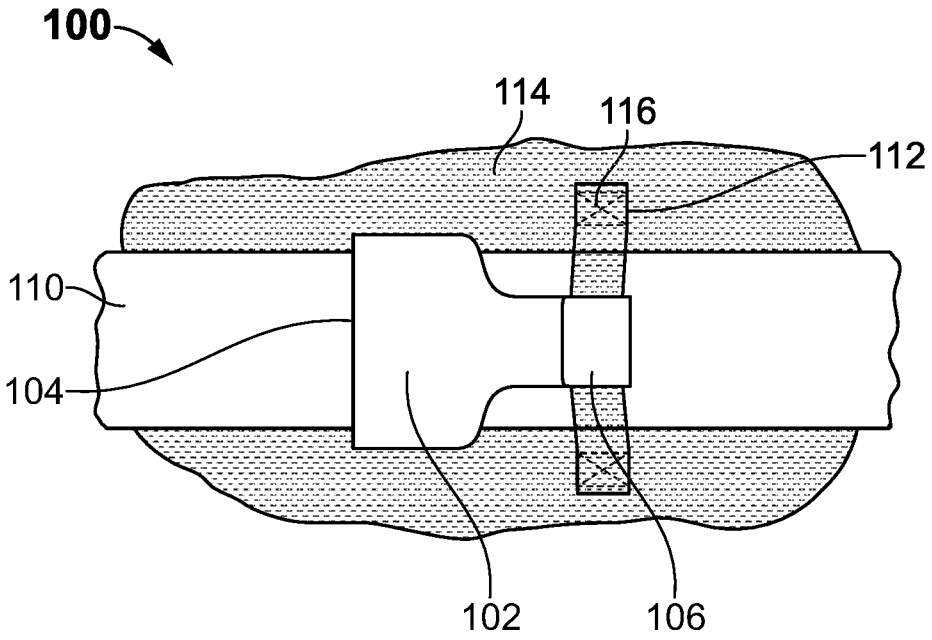
FIG. 6 is a front, plan view of the clip securing a belt to a trouser belt loop.

The present invention relates to a clip 100 for securing an unbuckled belt 110 loaded with accessory items, such as a phone, a gun 77, or a radio. The device comprises a hollow sleeve 102 having an open first end 104, an open second end 22, a rear surface, a front surface, a top edge and a bottom edge. A channel 108 extending from the first end to the second end is dimensioned and configured to firmly and slidably receive a garment belt 110. The lower edge could also be open to facilitate attachment to and removal from a belt. The channel 108 is defined by roughened, textured interior walls or surfaces that frictionally engage and grip the exterior surface of the belt to prevent slippage. For example, the interior surfaces could be constructed as follows:

| Recommended Surface Roughness (values in micrometers) | | |
|---|---|---|
| Normal Matte Finish | 320 Grit Stone | 0.63 to 0.70 |
| Satin Textured Finish | Dry Blast Glass Bead, #11 | 0.80 to 1.00 |
| Dull Textured Finish | Dry Blast #240 Oxide | 1.00 to 2.80 |
| Rough Textured Finish | Dry Blast #24 Oxide | 3.20 to 18.0 |

The second end 22 of the sleeve includes a J-shaped hook member 106 extending outwardly therefrom for gripping a belt loop 112 on a trouser 114 or other garment. Preferably, the sleeve and hook member form a unitary clip having no detachable or moving components to minimize construction costs.

Accordingly, a belt loaded with one or more accessory items is passed through the channel and buckled in a conventional fashion. The hook is then secured to a nearby belt loop 112 such that when the belt is unbuckled, the clip prevents the loaded belt from slipping through the pants loops and falling onto an underlying surface. Moreover, the clip frees the hands that would otherwise be used to hold the belt when unbuckling. If the user wishes to load the belt with heavier items, two or more clips can be used for enhanced security. The sleeve is dimensioned to receive narrow, wide-profile, or any other style or size of existing belts.

The above-described device is not limited to the exact details of construction and enumeration of parts provided herein. The sleeve and hook are preferably constructed with a lightweight material, such as polypropylene plastic or a similar equivalent. The sleeve could also have a colored or decorative exterior to inconspicuously blend with jeans, khakis, or other colored garments. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a belt and a garment having at least one belt loop, a clip comprising:

a hollow sleeve, having an open first end and an open second end;

a channel extending from said open first end to said open second end, said channel slidably receiving said belt;

a hook at either of said open first end and said open second end, said hook secured to said belt loop.

2. The combination according to claim 1 where said channel is defined by roughened interior surfaces that frictionally engage said belt.

3. The combination according to claim 1 wherein said sleeve and said hook are integral.

4. The combination according to claim 1 wherein said hook is J-shaped.

* * * * *